United States Patent [19]

Beimesch et al.

[11] 4,326,070

[45] Apr. 20, 1982

[54] BETA DEUTERATED 2-ETHYLHEXANOL AND DERIVATIVES

[75] Inventors: Bruce J. Beimesch, Crescent Springs, Ky.; Clarence E. Clark, Jr., Cincinnati, Ohio

[73] Assignee: Emery Industries, Inc., Cincinnati, Ohio

[21] Appl. No.: 235,257

[22] Filed: Feb. 17, 1981

[51] Int. Cl.[3] ..... C07C 69/48; C07C 69/50; C07C 69/003; C07C 31/125

[52] U.S. Cl. ..... 560/190; 260/410.9 R; 560/265; 568/840

[58] Field of Search ..... 260/410.9 R; 568/840; 560/190, 265

[56] References Cited

U.S. PATENT DOCUMENTS

| | | | |
|---|---|---|---|
| 2,403,804 | 7/1946 | Kesslin et al. | 560/190 |
| 2,417,281 | 3/1947 | Wasson et al. | 560/190 X |
| 2,417,833 | 3/1947 | Lincoln et al. | 560/190 X |

*Primary Examiner*—Natalie Trousof
*Assistant Examiner*—Vera C. Clarke
*Attorney, Agent, or Firm*—Kenneth D. Tremain

[57] ABSTRACT

Beta deuterated 2-ethylhexanol and derivatives thereof, particularly esters of 2-d-2-ethylhexanol and mono- or dicarboxylic acids which are useful as lubricants, are provided. Improved resistance to oxidation is obtained with the deuterated ester products.

4 Claims, No Drawings

BETA DEUTERATED 2-ETHYLHEXANOL AND DERIVATIVES

BACKGROUND OF THE INVENTION

1. Field of the Invention:

The present invention relates to selectively deuterated alcohols, specifically beta deuterated 2-ethylhexanol, and to derivatives thereof. Derivatives encompassed by the invention contain one or more beta deuterated 2-ethylhexoxy moieties and primarily include esters of carboxylic acids and beta deuterated 2-ethylhexanol.

2. Description of the Prior Art:

It is known that the resistance to oxidation of petroleum-derived and synthetic hydrocarbon lubricants can be substantially improved by replacing the hydrogen atoms of the hydrocarbon oil with deuterium atoms.

Deuterated lubricating oils containing at least 95% deuterium, with respect to the sum of hydrogen and deuterium in said oil, are reported in U.S. Pat. Nos. 3,746,634 and 3,876,521. These essentially fully deuterated (perdeuterated) hydrocarbons have enhanced oxidation resistance and, as a result, are recommended for use in high-temperature lubrication applications.

It is generally accepted that a high degree of deuteration is necessary to obtain an appreciable improvement in the resistance to oxidation with hydrocarbon oils. For example, in U.S. Pat. No. 4,134,843 it is demonstrated that partial deuteration of hydrocarbon oils does not result in substantially improved oxidation resistance and, in order to achieve acceptable results at reduced deuterium levels, a mixture of nondeuterated and partially or fully deuterated hydrocarbon lubricants must be employed.

SUMMARY OF THE INVENTION

We have now discovered that ester derivatives of 2-ethylhexanol, which has been selectively deuterated, exhibit significantly enhanced thermal and oxidative stability. More specifically, esters of beta deuterated 2-ethylhexanol have been produced. In contrast to the highly deuterated hydrocarbon oils of the prior art, enhanced oxidation resistance is obtained with synthetic ester lubricant products of this invention by replacing only one of the available hydrogen atoms of the alcohol moiety with a deuterium atom. In addition to the obvious economic advantages associated with the use of less deuterium, the deuteration process is simplified and requires significantly lower reaction temperatures and the resulting products exhibit no undesirable isotopic effects. In other words, with the synthetic ester fluids of this invention derived from beta deuterated 2-ethylhexanol, all of the desirable properties of the nondeuterated ester fluid (viscosity, pour point, flash point, etc.) remain in tact while improving the thermal stability and oxidative resistance.

The beta deuterated compounds of this invention have the formula

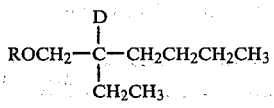

where R is hydrogen or an acyl radical selected from the group

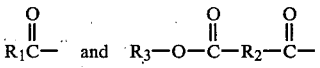

wherein $R_1$ is an alkyl group having from 5 to 17 carbon atoms, $R_2$ is an aliphatic bivalent hydrocarbon radical having from 4 to 10 carbon atoms, and $R_3$ is hydrogen, an alkyl group having from 1 to 4 carbon atoms, or 2-d-2-ethylhexyl radical. Diesters of azelaic acid and sebacic acid, that is, compounds of the above formula where R is

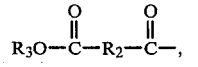

$R_2$ is a $-C_7H_{14}-$ or $-C_8H_{16}-$ radical, respectively, and $R_3$ is a 2-d-2-ethylhexoxy radical, are especially useful compounds of this invention.

DETAILED DESCRIPTION

This invention relates to beta deuterated 2-ethylhexanol (2-d-2-ethylhexanol) and derivatives thereof, particularly esters obtained by the reaction of 2-d-2-ethylhexanol with aliphatic carboxylic acids. The compounds of this invention correspond to the formula

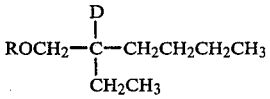

where R is hydrogen or an acyl radical selected from the group

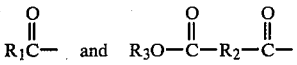

where $R_1$ is an alkyl group having from 5 to 17 carbon atoms, $R_2$ is an aliphatic bivalent hydrocarbon radical having from 4 to 10 carbon atoms, and $R_3$ is hydrogen, an alkyl group having from 1 to 4 carbon atoms, or 2-d-2-ethylhexyl radical.

Ester and diester products are obtained by reacting 2-d-2-ethylhexanol with a $C_{6-18}$ aliphatic monocarboxylic (fatty) acid or $C_{6-12}$ aliphatic dicarboxylic acid. Useful fatty acids include caproic acid, caprylic acid, pelargonic acid, capric acid, lauric acid, palmitic acid, myristic acid, stearic acid and the like. Useful aliphatic dicarboxylic acids include adipic acid, azelaic acid, sebacic acid and dodecanedioic acid. The ester and diester products may also be obtained by trans-alcoholysis wherein the beta deuterated 2-ethylhexanol is reacted with a $C_{1-4}$ alkyl ester of the mono- or dicarboxylic acid.

Diesters of azelaic or sebacic acid and 2-d-2-ethylhexanol are particularly advantageous. These products are useful lubricant fluids which, by virtue of their enhanced oxidative and thermal stability, can be used in applications where extreme conditions are encountered. The azelates and sebacates of the 2-d-2-ethylhexanol are superior to the undeuterated diester products and can be formulated in the conventional manner with known additives to provide a wide variety of useful high-temperature lubricants and greases.

In addition to the above-defined ester products, it will be evident to those skilled in the art that deuterated esters can also be obtained using aromatic acids and high molecular weight acids, such as polymeric fatty acids. Also, other products typically derived from alcohols can be prepared from the 2-d-2-ethylhexyl alcohol. For example, the beta deuterated 2-ethylhexanol could be converted to the alkali metal alkoxide and reacted with an alkyl halide, following the procedures developed for the Williamson synthesis, to form ethers.

The present invention will be more fully understood by referring to the following procedures which illustrate the preparation of the compounds of this invention and the superior properties obtained therewith. Beta deuterated 2-ethylhexanol was prepared from 2-ethylhex-1-enyl acetate by deuterolysis with deuterium oxide and then reducing to the alcohol. The 2-ethylhexenyl acetate was obtained by reacting 512.5 gms (4.0 moles) 2-ethylhexanal with 801.0 gms (8.0 moles) isopropenyl acetate using p-toluene sulfonic acid (2.4 gms) as the catalyst. To accomplish reaction, the mixture was heated at reflux for approximately 70 hours while periodically removing acetone via a suitable condenser arrangement. Upon removal of the excess isopropenyl acetate, the product was distilled under vacuum and 448.1 gms 2-ethylhexenyl acetate recovered at 35°–37° C./0.55 mm Hg. Infrared and nuclear magnetic resonance spectra were consistent with the desired product and gas chromatographic analysis indicated the 2-ethylhex-1-enyl acetate to be 99% pure.

To prepare the 2-d-2-ethylhexanal, 2-ethylhex-1-enyl acetate was refluxed with deuterium oxide in the presence of a small amount of sulfuric acid or sulfuric acid-$d_2$ catalyst. For example, 681 gms (4.0 moles) 2-ethylhexenyl acetate was combined with 96.1 gms (4.8 moles) deuterium oxide and 0.3 mls concentrated sulfuric acid and the mixture heated at reflux under nitrogen for three days. The reaction mixture was then cooled, diluted with ether, washed with saturated aqueous solutions of sodium carbonate, sodium bicarbonate and sodium chloride and dried over magnesium sulfate. A distilled yield of 79.2% (409.4 gms) 2-d-2-ethylhexanal was obtained (b.p. 52°–54° C./12–15 mm Hg). Infrared and nuclear magnetic resonance spectra (40% in $CDCl_3$; singlet at 9.50δ) were consistent with the desired product.

The beta deuterated 2-ethylhexanal was reduced with lithium aluminum hydride to produce the alcohol. For the reaction, 56.9 gms (1.50 moles) lithium aluminum hydride were charged to a reactor with 600 mls anhydrous diethyl ether and a solution of 387.7 gms (3.0 moles) 2-d-2-ethylhexanal in 100 mls ether added dropwise with stirring over a period of about 5 hours at a rate sufficient to maintain reflux. The mixture was then heated for one hour at reflux to insure complete reduction of the aldehyde. After cooling, water (60 mls) was added over a 3 hour period at a rate so that the temperature did not exceed 20° C. This was followed by the addition to 62.6 gms sodium hydroxide and additional water (180 mls). The mixture was filtered to remove the white precipitate and the filtrate evaporated to obtain 382.7 gms crude product (97.2% yield). Three-hundred and fifty-five grams 2-d-2-ethylhexanol (99% purity and greater than 90% deuterium incorporation) was recovered upon vacuum distillation (b.p. 70° C./10 mm Hg). The structure of the product was confirmed by infrared, nuclear magnetic resonance spectroscopy and mass spectroscopy.

To demonstrate the ability to obtain useful diester lubricating fluids having enhanced oxidative and thermal stability, di(2-d-2-ethylhexyl)azelate was prepared by reacting azelaic acid with a molar excess 2-d-2-ethylhexyl alcohol. The reaction was carried out at 220°–225° C. with agitation while maintaining a nitrogen flow and using 0.03 wt. % esterification catalyst. Water was removed throughout the course of the reaction and during the final stages of reaction a vacuum was applied to distill off the final traces of water and the excess 2-d-2-ethylhexanol. The crude diester product (acid value <5; hydroxyl value <2) was then filtered through diatomaceous earth and alkali refined by contacting with 20% aqueous sodium hydroxide followed by water washing to obtain the neutral ester. The final alkali-refined di(2-d-2-ethylhexyl)azelate had an acid value of 0.004 and hydroxyl value of 1.2.

Employing a procedure similar to that described above but substituting sebacic acid for the azelaic acid, di(2-d-2-ethylhexyl)sebacate was prepared. Also, in a similar manner esters of mixed $C_{6-8}$ fatty acids and 2-d-2-ethylhexanol were prepared. Properties of the esters prepared with 2-d-2-ethylhexyl alcohol were essentially identical to the properties of identical esters obtained using undeuterated 2-ethylhexanol. However, the deuterated ester products of this invention did exhibit improved resistance to oxidation. For example, the properties of diesters of azelaic acid are as follows:

| | di(2-ethylhexyl)azelate | di(2-d-2-ethylhexyl)azelate |
|---|---|---|
| Viscosity at 210° F. | 2.93 centistokes | 2.93 centistokes |
| Viscosity at 100° F. | 10.72 centistokes | 10.88 centistokes |
| Color (440/550 mμ) | 90/100 min. | 90/100 min. |
| Cloud Point | <90° F. | <90° F. |
| Pour Point | <90° F. | <90° F. |

For comparative purposes and to demonstrate the improved oxidation resistance of the beta deuterated products of this invention, open tube oxidation tests were conducted with the di(2-ethylhexyl)azelate and di(2-d-2-ethylhexyl)azelate. For the test 60 gms of the diester was placed in a 30 mm×22 mm glass tube. The tube and its contents were then heated at 218° C. and dry air introduced at the rate of 6 liters per hour through a 4 mm glass tube inserted into the liquid within ⅛" of the bottom. After 7½ hours the acid value of the di(2-d-2-ethylhexyl)azelate increased to 9.8 whereas the acid value of the di(2-ethylhexyl)azelate was 13.9. The significantly lower acid value obtained with the deuterated diester product of this invention clearly demonstrates its enhanced oxidative stability.

To further demonstrate the superiority of the beta deuterated products of this invention, di(2-ethylhexyl)azelate and di(2-d-2-ethylhexyl)azelate were evaluated under Federal Test Method Standard 5308.6. This is the test method used by the Air Force in evaluating the oxidation and corrosion resistance of 3 cSt. diester-based fluids. Fully compounded diester fluids are used for the test and the di(2-ethylhexyl)azelate and di(2-d-2-ethylhexyl)azelate were formulated as follows:

| | Weight Percent |
|---|---|
| Diester Basestock | 95.93 |
| Antioxidant | 2.00 |

-continued

| | Weight Percent |
|---|---|
| E.P. Additive | 2.00 |
| Metal Deactivator | 0.07 |

The formulated basestocks were then heated at 347° F. while introducing air (5 liters per hour) with copper, steel, aluminum, magnesium and silver coupons present. Samples were removed at various intervals and acid values determined. The product is deemed to have failed when an acid value of 2.0 is reached. Results were as follows:

| | ACID VALUE | |
|---|---|---|
| HOURS | di(2-ethylhexyl)azelate | di(2-d-2-ethylhexyl)azelate |
| 0 | 0.34 | 0.43 |
| 20 | 0.51 | 0.68 |
| 44 | 0.90 | 1.11 |
| 51.5 | 1.03 | 0.98 |
| 68 | 1.20 | 1.28 |
| 75.5 | 1.41 | 1.07 |
| 92 | 1.75 | 1.41 |
| 116 | 2.10 | 1.50 |
| 164 | 2.65 | 1.84 |
| 212 | 3.51 | 2.65 |

It is apparent from the above data, that the fluid based on the diester of azelaic acid and beta deuterated 2-ethylhexyl alcohol exhibited approximately 40% increase in oxidation resistance compared to the basestock formulated with the non-deuterated diester product.

We claim:

1. Beta deuterated compounds of the formula

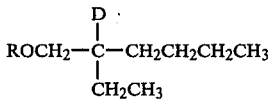

where R is hydrogen or an acyl radical selected from the group

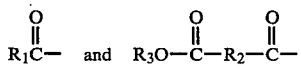

wherein $R_1$ is an alkyl group having from 5 to 17 carbon atoms, $R_2$ is an aliphatic bivalent hydrocarbon radical having from 4 to 10 carbon atoms and $R_3$ is hydrogen, the radical

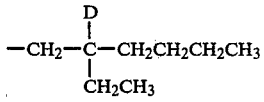

or an alkyl group having from 1 to 4 carbon atoms.

2. Beta deuterated compounds of claim 1 wherein $R_2$ is a $—C_7H_{14}—$ or $—C_8H_{16}—$ radical.

3. Di(2-d-2-ethylhexyl)azelate.

4. Di(2-d-2-ethylhexyl)sebacate.

* * * * *